United States Patent [19]

Cioffi

[11] Patent Number: 4,702,644

[45] Date of Patent: Oct. 27, 1987

[54] TRUCK MOUNTED ROLLER

[76] Inventor: Dominic A. Cioffi, 4107 Middletown Rd., Canfield, Ohio 44406

[21] Appl. No.: 863,950

[22] Filed: May 16, 1986

[51] Int. Cl.[4] ..... E01C 19/26

[52] U.S. Cl. ..... 404/128; 404/86

[58] Field of Search ..... 404/85, 86, 103, 122, 404/128, 129; 180/20; 172/606, 610, 483

[56] References Cited

U.S. PATENT DOCUMENTS

| | | | |
|---|---|---|---|
| 1,211,558 | 1/1917 | Drummond | 404/128 |
| 2,534,507 | 12/1950 | Essick | 404/122 |
| 2,777,709 | 1/1957 | Tucker | 180/20 X |
| 3,665,823 | 5/1972 | Chaney et al. | 404/128 |
| 3,895,880 | 7/1975 | Fink | 404/128 X |
| 3,932,052 | 1/1976 | Fink | 404/128 |
| 4,040,762 | 8/1977 | Nilsson | 404/129 |
| 4,157,877 | 6/1979 | Lee | 404/128 |
| 4,422,796 | 12/1983 | Tavernier | 404/128 |

*Primary Examiner*—James A. Leppink
*Assistant Examiner*—Matthew Smith
*Attorney, Agent, or Firm*—Harpman & Harpman

[57] ABSTRACT

A detachable roller for use on trucks that provides a portable multi-adjustable roller for compaction of material. The detachable roller has independently actuated roller control pistons that engage and disengage the roller to the compaction surface. The roller can adjust to uneven terrain by angular displacement of the roller's longitudinal axis support points.

2 Claims, 3 Drawing Figures

TRUCK MOUNTED ROLLER

BACKGROUND OF THE INVENTION

1. Technical Field:

This invention relates to roller assemblies that are positioned on trucks or the like to be used in material compaction such as asphalt paving.

2. Description of the Prior Art:

Prior art devices of this type have relied on a variety of different design characteristics to be removably positioned on a truck. See for example U.S. Pats. Nos. 3,932,052, 3,895,880, and U.S. Pat. No. 718,870.

In U.S. Pat. No. 3,932,052, a roller attachment is disclosed that users a fluid motor and gear rack secured to support plates with a roller positioned therebetween. The roller can be raised and lowered vertically along the gear rack.

U.S. Pat. No. 3,895,880 discloses a roller attachment for trucks having rollers positioned between and attached to the ends of oppositely disposed hydraulic piston and cylinder assemblies that are secured to a transversely positioned I-beam which has an integral hydraulic fluid tank.

In U.S. Pat. No. 718,870, a land roller is shown having rollers mounted in bearing boxes movably positioned in a guide track of a support frame. The bearing boxes are spring urged in vertically aligned guide tracks by pairs of opposing springs allowing the roller bearings to float vertically to compensate for terrain variations.

SUMMARY OF THE INVENTION

A multiple adjustable roller assembly that is detachably positioned on trucks for the compaction of varied material. The roller independently adjusts along its longitudinal axis both vertically and horizontally providing for a broad range of angular positioning to compensate for uneven compaction surfaces both vertically and transversely uneven.

DESCRIPTION OF THE PREFERRED EMBODIMENT

Figure 1:
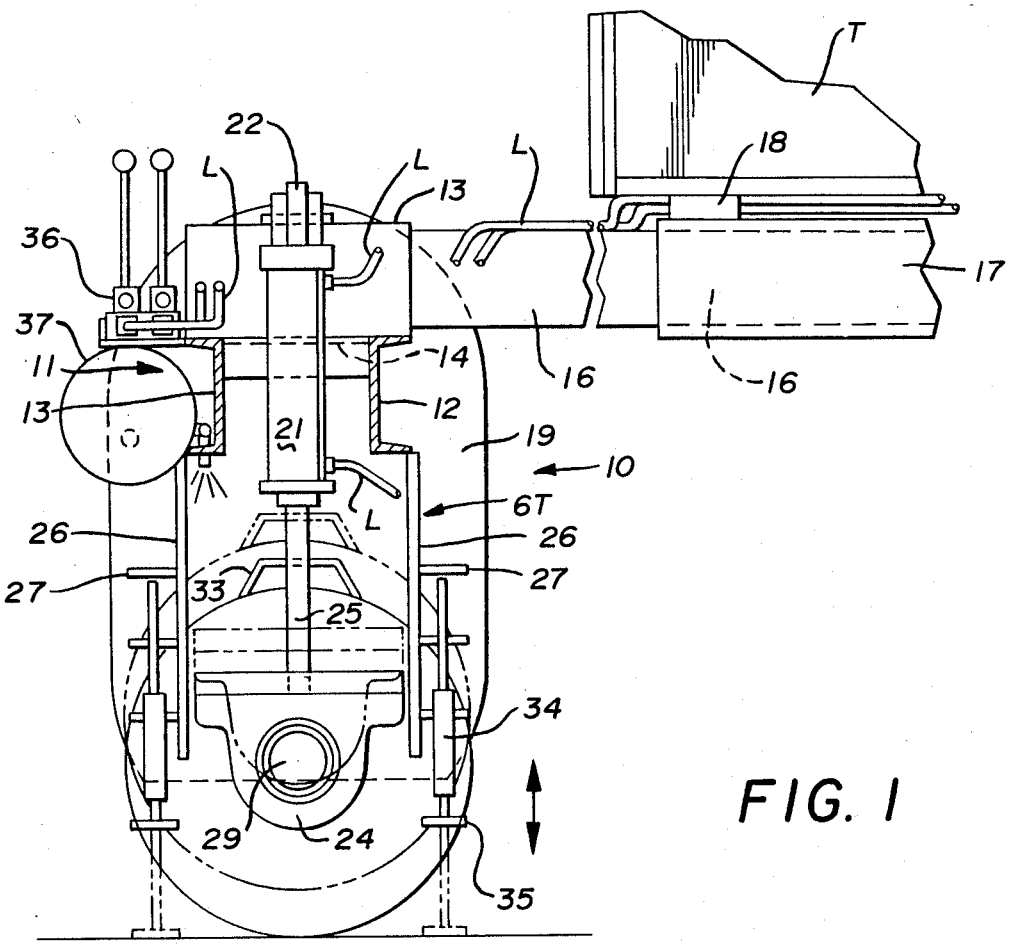
FIG. 1 is a side elevation of the roller attachment and a portion of a truck to which it is attached.
Figure 3:
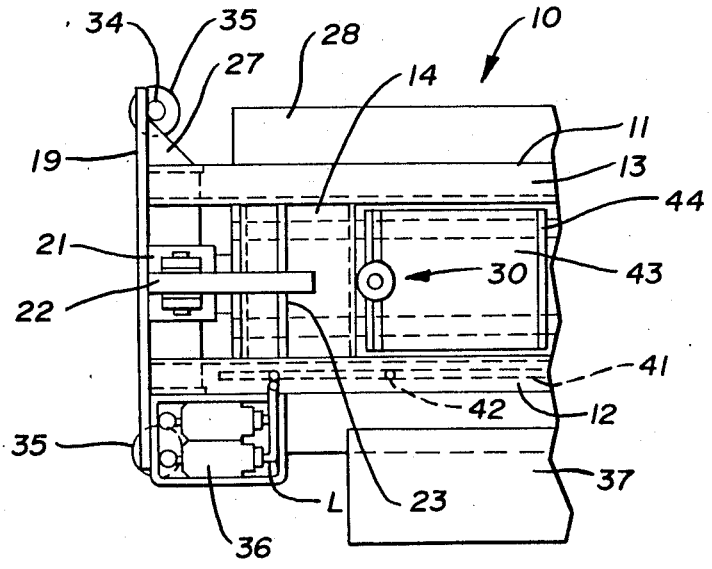
FIG. 3 is a top plan view with a portion cutaway of the roller attachment and control mechanism.
Figure 2:
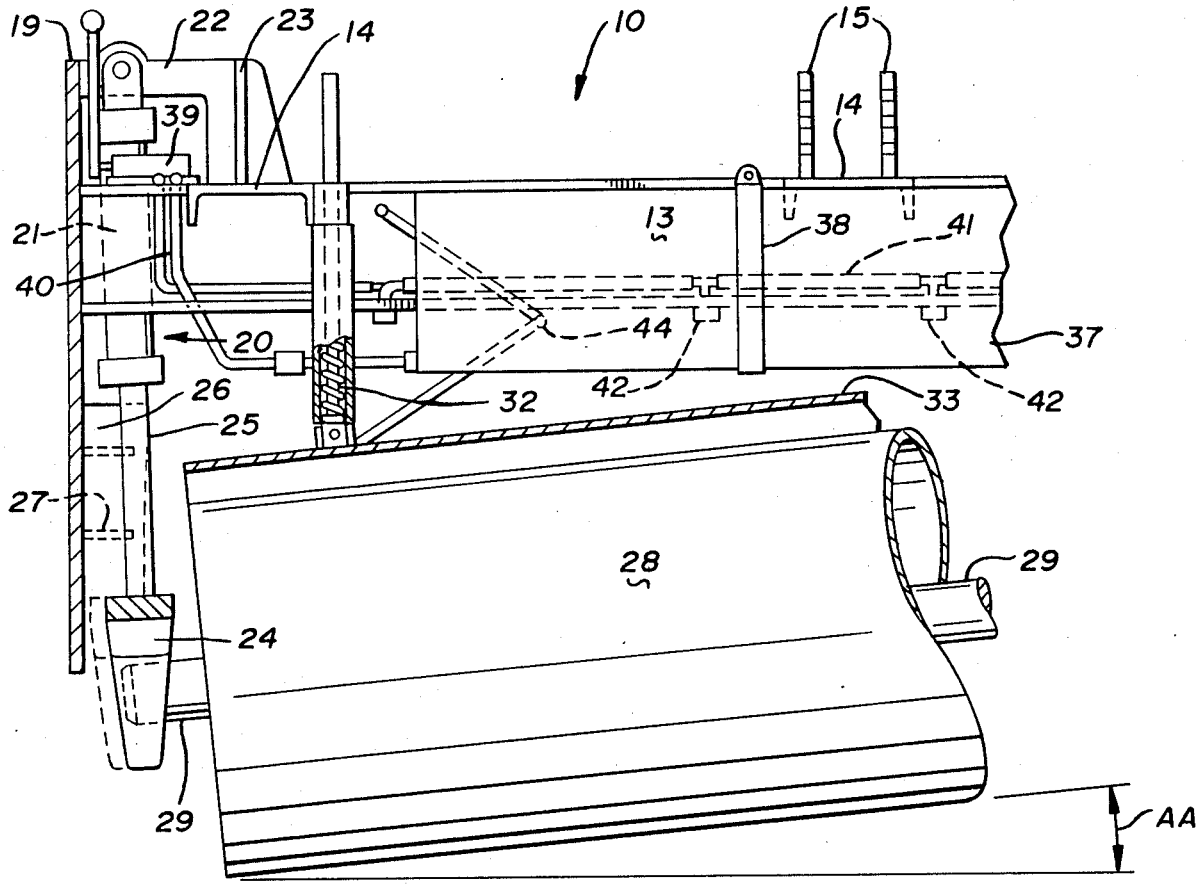
FIG. 2 is an enlarged end elevation of the roller's point of attachment and supporting structure.

A detachable roller assembly 10 can be seen in FIGS. 1, 2 and 3 of the drawings comprising a main support frame 11 having horizontally spaced parallel beam members 12 and 13 interconnected to one another by a plurality of transversely positioned longitudinally spaced support members 14. Pairs of mounting brackets 15 are secured on at least two of said support members 14 with each of the brackets 15 apertured to receive support arms 16 which extend from the roller assembly 10 to a vehicle (T) seen in FIG. 1 of the drawings. Each of the support arms 16 is registrably positioned on their free ends in an arm support socket 17 affixed to the vehicle T via spacers 18. End frame plates 19 are vertically positioned on the respective free ends of said beam members 12 and 13 extending above and below said beam members. A pair of oppositely disposed roller support assemblies 20 are positioned at either end of said main support frame 11 and comprises a hydraulic piston and cylinder 21 pivotally mounted at its cylinder end to an apertured L-shaped frame member 22 secured to said end frame plates by gussets 23 to said other two of said support members respectively.

A bearing support block 24 is secured to the free end of a piston rod 25 extending from said piston and cylinder assembly 21. A vertically aligned guide track (6T) is formed on the inner facing surface of the end frame plate 19 comprised of spaced parallel ribs 26 and right angularly extending reinforcing tabs 27.

It will be evident to those skilled in the art that the bearing support blocks 24 will be restricted to movement both vertically and horizontally parallel of the longitudinal axis of the main support frame 11. The roller 28 is positioned on a shaft 29 and is rotatably positioned in the bearing support block 24 as will be well understood by those skilled in the art.

A pair of spring tensioning rods 30 are secured to the main support frame adjacent the L-shaped apertured frame member 22 and are comprised of a cylinder housing 31, a spring urged rod 32 within said housing. The rod is pivotally connected to an encasement cleaner frame and mat assembly 33 that is commonly used in the art to clean paving rollers and the like.

Referring now to FIG. 1 of the drawings, pairs of extensible and retractable support feet 34 attached to rods are secured to and extend from said frame plates 19. The rods have pads 35 for selective engagement with the ground G. Control valves 36 are positioned on the detachable roller assembly 10 and are interconnected to said piston and cylinder assembly 21 via control lines L and a source of hydraulic pressure (not shown) on the vehicle (T).

Referring to FIGS. 2 and 3 of the drawings, a water storage tank 37 can be seen secured to the parallel beam 13 by straps 38. The tank 37 supplies water via a control valve 39 and supply lines 40 to a spray manifold 41 which extends along the lower portion of the parallel beam 13 and has a plurality of longitudinally spaced spray nozzles 42 positioned therealong and aligned to spray the roller 28 as will be well understood by those skilled in the art.

A stabilizer scissor hinge bracket 43 extends from the beam 13 to the cleaner frame and mat assembly 33 at the point of attachment of the spring tensioning rods 30 as best seen in FIG. 2 of the drawings. The bracket 43 has a hinge point 44 and is used to provide transverse and vertical stabilization of the cleaner frame and mat assembly 33.

In operation, once the detachable roller assembly is attached to the vehicle (T) and the retractable support feet 34 are retracted, the roller 28 can be raised and lowered by the hydraulic piston and cylinder assembly according to the selective input of the control valves 36. It should be noted that when the roller 28 is in down position and it encounters varied compaction surfaces, it will adjust accordingly due to the pivot of the roller support assembly (as indicated by the dotted lines in FIG. 2 of the drawings) and the given amount of play in the bearings in the support blocks 24 with the amount of angular inclination variation of the roller 28 indicated by the double arrows AA in FIG. 2 of the drawings.

Varied control of the relative position of the roller 28 is accomplished by the operator imput via the control valves 36 and associated fluid supply lines (L) connected to a source of hydraulic pressure, not shown, on the vehicle (T).

It will thus be seen that a new and useful truck mounted roller assembly has been illustrated and described and it will be apparent to those skilled in the art that various changes and modifications may be made therein without departing from the spirit of the invention and having thus described our invention what I claim is:

1. An improvement in a detachable truck mounted roller, the truck mounted roller comprising a main support frame with support arms extending therefrom for mounting on a truck, end plates on the free ends of the support frames, pairs of roller support assemblies secured inwardly of either end of the main support frame, and an encasement cleaner frame and mat assembly engaging the roller of the assembly, the roller having a roller shaft extending longitudinally through the roller and having end faces that are oriented transversely of the longitudinal axis of the roller shaft, the improvement in combination therewith comprising:

the end frame plates being spaced apart from each other a distance greater than the axial length of the roller shaft so that the roller shaft and the roller can move along the longitudinal axis of the roller shaft between the end frame plates;

the roller support assemblies each including a vertically oriented hydraulic piston/cylinder assembly having the cylinder thereof spaced from an adjacent end frame plate and pivotably attached to the support frame to be pivotably movable toward and away from that adjacent end frame plate, said piston/cylinder assembly further including a piston rod extending downwardly from said cylinder and movable therewith toward and away from the adjacent end frame plate and a bearing support block fixedly mounted on the end of said piston rod remote from said cylinder for movement therewith toward and away from the adjacent end frame plate, guide means mounted on the end frame plate to slidably engage said bearing support block for guiding said bearing support block in vertically directed movement and in movement toward and away from the adjacent end frame plate, said guide means including a pair of guide rails mounted on the adjacent end frame plate to be located adjacent to said bearing support block and which extend outwardly from the adjacent end frame plate a distance sufficient to remain in bearing support block guiding position with respect to said bearing support block when said bearing support block moves away from the adjacent end frame plate, thrust accommodating means in said bearing block which receives one end of the roller shaft and which abuts the roller shaft end face associated with that end of the roller shaft so that movement of the roller shaft along the longitudinal axis thereof toward the adjacent end frame plate causes said bearing support block to move toward the adjacent end frame plate so that movement of the roller in a direction along the longitudinal axis of the roller shaft and movement of the roller in a vertical direction are both permitted whereby the roller can move to compensate for compaction surfaces that are uneven in both the vertical and the transverse directions; and means for transversely stabilizing the encasement cleaner frame.

2. The improvement to a detachable truck mounted roller of claim 1 wherein said guide means on said end plate comprising spaced parallel vertically aligned ribs defining a vertical channel.

* * * * *